US012752389B2

(12) United States Patent
Takenouchi et al.

(10) Patent No.: US 12,752,389 B2
(45) Date of Patent: Oct. 6, 2026

(54) WAFER GRINDING METHOD

(71) Applicant: DISCO CORPORATION, Tokyo (JP)

(72) Inventors: Kenji Takenouchi, Tokyo (JP); Mitsutane Kokubu, Tokyo (JP); Masayoshi Teramoto, Tokyo (JP); Koichi Kunimoto, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 304 days.

(21) Appl. No.: 18/617,807

(22) Filed: Mar. 27, 2024

(65) Prior Publication Data

US 2024/0335918 A1 Oct. 10, 2024

(30) Foreign Application Priority Data

Apr. 10, 2023 (JP) ..... 2023-063577

(51) Int. Cl.
*B24B 7/22* (2006.01)
*B24B 41/06* (2012.01)
*B24B 55/02* (2006.01)

(52) U.S. Cl.
CPC ..... *B24B 7/228* (2013.01); *B24B 41/068* (2013.01); *B24B 55/02* (2013.01)

(58) Field of Classification Search
CPC ..... B24B 7/228; B24B 41/068; B24B 55/02
See application file for complete search history.

(56) References Cited

U.S. PATENT DOCUMENTS

| | | | | |
|---|---|---|---|---|
| 7,238,087 | B1 * | 7/2007 | Kashiwa | B24B 37/04 451/287 |
| 8,765,653 | B2 * | 7/2014 | Tamboli | H05K 3/26 510/178 |
| 9,620,374 | B2 * | 4/2017 | Kido | C30B 29/36 |
| 10,008,398 | B2 | 6/2018 | Choi et al. | |
| 2011/0081836 | A1 * | 4/2011 | Schwandner | H10P 90/123 451/41 |
| 2011/0165823 | A1 * | 7/2011 | Ide | B24B 37/00 451/340 |
| 2014/0202491 | A1 * | 7/2014 | Vogtmann | B24B 7/228 134/6 |

(Continued)

FOREIGN PATENT DOCUMENTS

| | | |
|---|---|---|
| DE | 102009048436 B4 | 12/2012 |
| JP | 2009141176 A | 6/2009 |
| JP | 6713214 B2 | 6/2020 |

OTHER PUBLICATIONS

Office Action issued in counterpart German patent application No. 10 2024 203 051.1, dated Dec. 10, 2024.

(Continued)

*Primary Examiner* — Omar Flores Sanchez
(74) *Attorney, Agent, or Firm* — Greer, Burns & Crain, Ltd.

(57) ABSTRACT

A wafer grinding method for grinding, by a grindstone, a reverse side of a wafer formed on a face side thereof with devices includes a protective member forming step of covering a whole area of the face side of the wafer with a protective member, a holding step of holding the wafer by a chuck table with the protective member therebetween, and a grinding step of grinding the reverse side of the wafer by the grindstone while supplying grinding water containing a surfactant to the grindstone and the wafer.

13 Claims, 7 Drawing Sheets

(56) References Cited

U.S. PATENT DOCUMENTS

| | | | | |
|---|---|---|---|---|
| 2015/0266155 | A1* | 9/2015 | Kitamura | B24B 9/065 451/41 |
| 2019/0067018 | A1* | 2/2019 | Takenouchi | B24B 5/045 |
| 2019/0111537 | A1* | 4/2019 | Kakefuda | B24B 7/228 |
| 2019/0333799 | A1 | 10/2019 | Seddon | |
| 2020/0230773 | A1* | 7/2020 | Hirosawa | B24B 7/22 |
| 2021/0210353 | A1* | 7/2021 | Lee | B24B 7/228 |
| 2022/0097197 | A1* | 3/2022 | Joeng | B24B 7/228 |
| 2022/0305617 | A1* | 9/2022 | Kamiki | B24B 37/015 |
| 2024/0017368 | A1* | 1/2024 | Gokita | B24B 7/228 |
| 2025/0282016 | A1* | 9/2025 | Bubel | B24B 7/228 |
| 2025/0285873 | A1* | 9/2025 | Bubel | B24B 7/228 |

OTHER PUBLICATIONS

Office Action issued in counterpart Singapore Patent Application No. 110202400922W, dated Mar. 17, 2026.

* cited by examiner

WAFER GRINDING METHOD

BACKGROUND OF THE INVENTION

Field of the Invention

The present invention relates to a grinding method for a wafer held by a chuck table.

Description of the Related Art

For instance, since size reduction and thickness reduction of various electronic apparatuses such as personal computers and smart phones have been demanded, there has also been a trend toward size reduction and thickness reduction of semiconductor devices used for these electronic apparatuses. In other words, in the manufacturing process of the semiconductor devices, a face side of a disk-shaped semiconductor wafer (simply referred to as a "wafer" below) is partitioned by a plurality of scheduled division lines called streets arranged in a grid pattern into a multiplicity of rectangular regions, and a device such as an integrated circuit (IC) and a large-scale integration (LSI) circuit is formed in each of the rectangular regions. The wafer thus formed with the multiplicity of devices is cut along the scheduled division lines, whereby a plurality of semiconductor chips are formed.

For realizing the size reduction and thickness reduction of the individual semiconductor chips, normally, a reverse side (a surface on the side opposite to the surface formed with the devices) of the wafer is ground before the wafer is cut along the scheduled division lines. The grinding of the wafer is conducted by pressing grindstones in high-speed rotation against the reverse side of the wafer, and, at the time of the grinding, grinding water is supplied to a contact region (grinding region) between the wafer and the grindstones, to thereby cool the contact region (grinding region) and remove swarf (see, for example, Japanese Patent Laid-open No. 2009-141176).

SUMMARY OF THE INVENTION

Incidentally, the swarf generated by grinding of the wafer contains abrasive grains having fallen off from the grindstones, and in a case where the fallen-off abrasive grains invade into an area between a to-be-ground surface (reverse side) of the wafer and lower surfaces (grinding surfaces) of the grindstones during grinding, scratches deeper than grinding traces formed by the grindstones may be formed in the to-be-ground surface of the wafer. These scratches cause a lowering in the die strength of the chips obtained by dividing the wafer after the grinding.

Accordingly, it is an object of the present invention to provide a wafer grinding method by which it is possible to restrain formation of scratches in the to-be-ground surface of a wafer and prevent a lowering in the die strength of the chips obtained by dividing the wafer.

In accordance with an aspect of the present invention, there is provided a wafer grinding method for grinding, by a grindstone, a reverse side of a wafer formed on a face side thereof with a plurality of devices, the wafer grinding method including a protective member forming step of covering a whole area of the face side of the wafer with a protective member, a holding step of holding the wafer by a chuck table with the protective member therebetween, and a grinding step of grinding the reverse side of the wafer by the grindstone while supplying grinding water containing a surfactant to the grindstone and the wafer.

According to the present invention, at the time of grinding, in the grinding step, the reverse side of the wafer held by the chuck table with the protective member therebetween in the holding step, the grinding water containing the surfactant is supplied to the grindstone and the wafer, so that abrasive grains having fallen off from the grindstone during grinding are separated and removed from the grinding water by an action of the surfactant. Hence, invasion of the abrasive grains into the area between the lower surface (grinding surface) of the grindstone and the reverse side (to-be-ground surface) of the wafer is prevented, and formation of scratches in the reverse side of the wafer by the abrasive grains is restrained. As a result, a lowering in the die strength of the chips obtained by dividing the ground wafer is prevented.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

A mode of carrying out the present invention will be described below with reference to the attached drawings. First, a configuration of a grinding apparatus for carrying out a grinding method according to the present invention will be described with reference to FIG. 1. Note that, in the following description, arrow directions depicted in FIG. 1 are an X-axis direction (left-right direction), a Y-axis direction (front-back direction), and a Z-axis direction (vertical direction).

Figure 1:
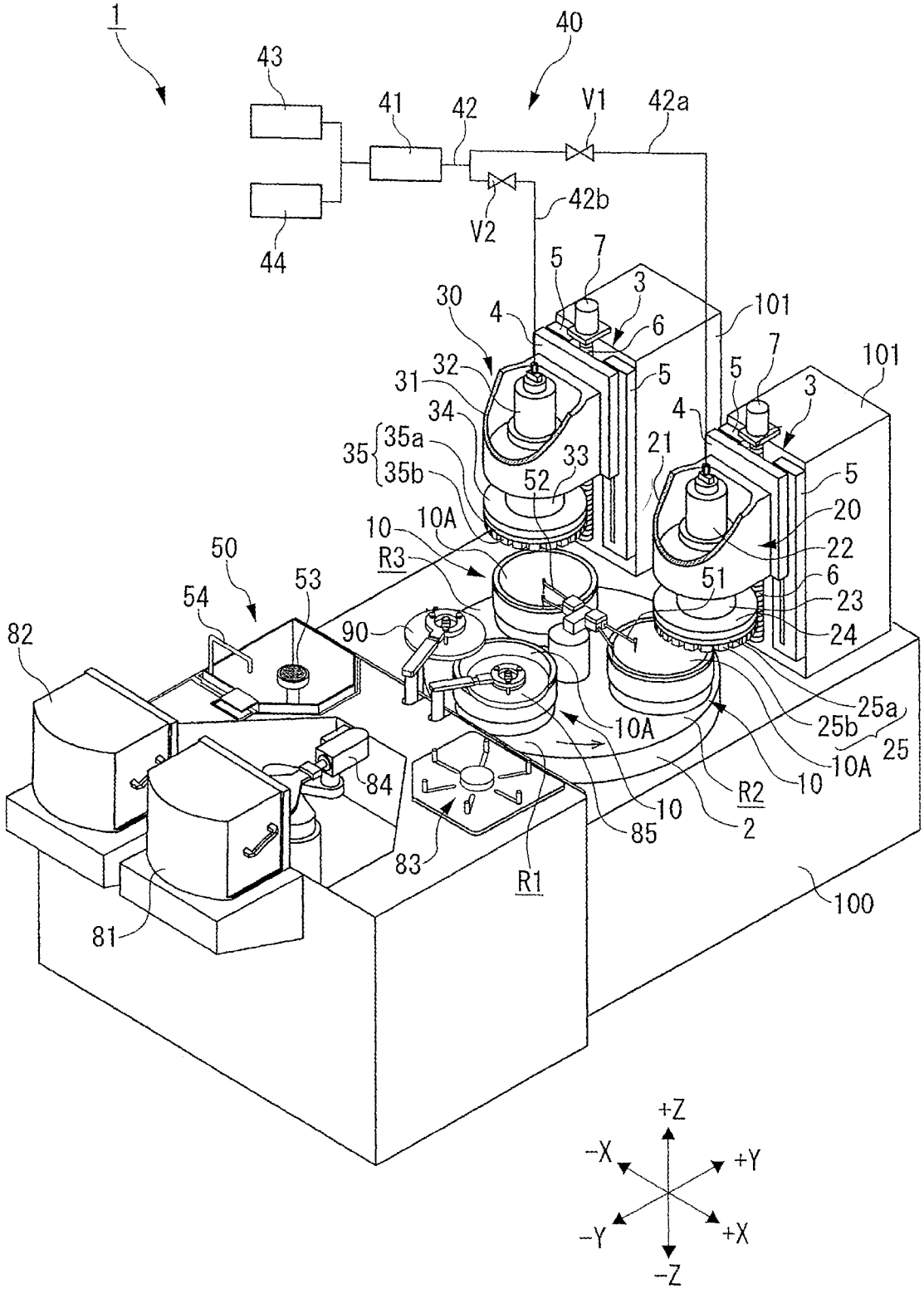
FIG. 1 is a perspective view depicting, partly in cross-section, a grinding apparatus for carrying out a wafer grinding method according to the present invention.
Figure 2:
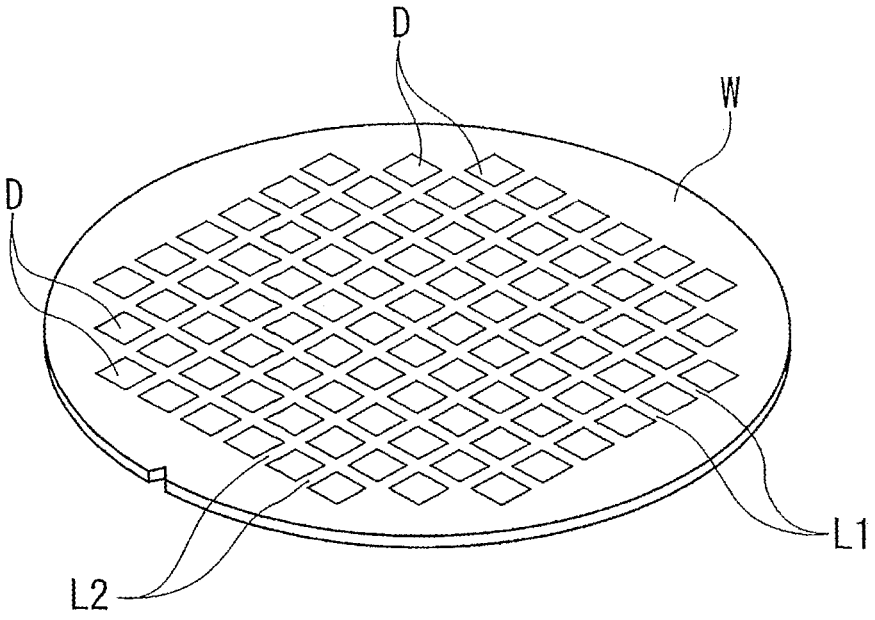
FIG. 2 is a perspective view of a wafer.

A grinding apparatus 1 depicted in FIG. 1 is an apparatus for grinding a disk-shaped wafer W (see FIGS. 2, 3A, and 3B) which is a workpiece, and includes, as main constituent elements, three chuck tables 10 disposed on a disk-shaped rotatable turntable 2, a rough grinding unit 20 and a finish grinding unit 30 that grind the wafer W held on the chuck table 10, and a grinding water supply unit 40 that supplies grinding water to a grinding region of the wafer W held on the chuck table 10. Here, as depicted in FIG. 2, the wafer W has a face side (in FIG. 2, an upper surface) partitioned by a plurality of intersecting scheduled division lines L1 and L2 called streets arranged in a grid pattern into a multiplicity of rectangular regions, and a device D such as an IC and an LSI circuit is formed in each of the rectangular regions. To the face side of the wafer W thus formed with the multiplicity of devices D, a protective tape T for protecting the devices D is stuck, and, by cutting the wafer W along the scheduled division lines L1 and L2, a plurality of semiconductor chips are obtained.

Note that the grinding apparatus 1 includes, as other constituent elements, thickness measuring devices 51 and 52 for measuring the thickness of the wafer W during grinding, a cleaning unit 50 for cleaning the wafer W having undergone grinding, a cassette 81 for accommodating a plurality of the wafers W before being ground, a cassette 82 for accommodating the wafers W having undergone grinding, an alignment table 83 for aligning the wafer W taken out from the cassette 81, a conveying-in/out robot 84 for putting the wafers W into and out of the cassettes 81 and 82 and conveying the wafer W taken out from the cassette 81 to the alignment table 83, a first conveying unit 85 for conveying the wafer W aligned at the alignment table 83 to the chuck table 10 located in a wafer conveying-in/out region R1, a second conveying unit 90 for detaching the wafer W having undergone finish grinding in a finish grinding region R3 from the chuck table 10 and conveying the wafer W to the cleaning unit 50, and the like, the detailed descriptions of them being omitted.

Here, configurations of the chuck tables 10, the rough grinding unit 20, the finish grinding unit 30, and the grinding water supply unit 40, which are main constituent elements of the grinding apparatus 1, will be described.

The three chuck tables 10 are each a disk-shaped member, and are disposed on the turntable 2, which is intermittently rotated around a center axis perpendicular to the Z-axis direction, at a regular angular pitch (120° pitch) in a circumferential direction. The chuck tables 10 can be revolved around an axial center parallel to the Z-axis direction of the turntable 2 by an angle of 120° at a time by the intermittent rotation of the turntable 2, to be sequentially moved between the wafer conveying-in/out region R1, a rough grinding region R2, and the finish grinding region R3, and can be rotated at a predetermined speed around axial centers by an unillustrated rotating mechanism.

Figure 4:
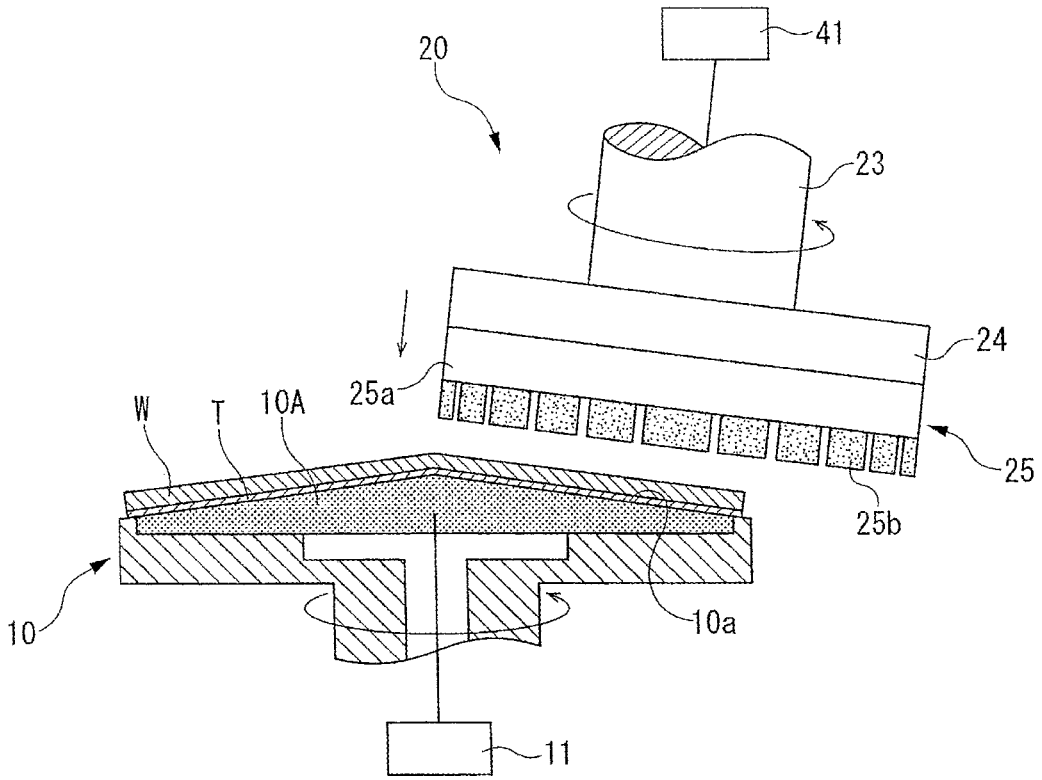
FIG. 4 is a partial side sectional view depicting a holding step and a rough grinding step of the wafer grinding method according to the present invention.

Here, as illustrated in FIG. 4, each of the chuck tables 10 has a disk-shaped porous member 10A that is formed of a porous ceramic and is incorporated in a central part thereof, and an upper surface of each porous member 10A constitutes a holding surface 10*a* that holds the disk-shaped wafer W under suction. The porous member 10A of each chuck table 10 is selectively connected to a suction source 11 (see FIG. 4) such as a vacuum pump, as will be described later.

The grinding apparatus 1 according to the present embodiment includes the rough grinding unit 20 and the finish grinding unit 30, and, as depicted in FIG. 1, the rough grinding unit 20 and the finish grinding unit 30 are each disposed vertically in the state of being juxtaposed in the X-axis direction (left-right direction) at a +Y axis direction end part (rear end part) of a rectangular box-shaped base 100 elongate in the Y-axis direction (front-rear direction). Here, the rough grinding unit 20 is a unit for rough grinding of a reverse side (in FIG. 4, the upper surface) of the wafer W held on the holding surface 10*a* of the chuck table 10 located in the rough grinding region R2, whereas the finish grinding unit 30 is a unit for finish grinding of the reverse side (in FIG. 7, the upper surface) of the wafer W held on the holding surface 10*a* of the chuck table 10 located in the finish grinding region R3, and the rough grinding unit 20 and the finish grinding unit 30 are the same in fundamental configuration.

In other words, the rough grinding unit 20 includes a spindle motor 22 fixed to a holder 21, a spindle 23 rotationally driven by the spindle motor 22, a disk-shaped mount 24 attached to a lower end of the spindle 23, and a grinding wheel 25 detachably mounted to a lower surface of the mount 24. Here, the grinding wheel 25 includes a disk-shaped base 25*a* and a plurality of grindstones 25*b* attached in an annular pattern to a lower surface of the base 25*a*.

In addition, like the rough grinding unit 20, the finish grinding unit 30 includes a spindle motor 32 fixed to a holder 31, a spindle 33 rotationally driven by the spindle motor 32, a disk-shaped mount 34 attached to a lower end of the spindle 33, and a grinding wheel 35 detachably mounted to a lower surface of the mount 34. Here, the grinding wheel 35 includes a disk-shaped base 35*a* and a plurality of grindstones 35*b* attached in an annular pattern to a lower surface of the base 35*a*, the grindstones 35*b* including abrasive grains finer than those of the grindstones 25*b* of the rough grinding unit 20.

Incidentally, the rough grinding unit 20 and the finish grinding unit 30 are supported in such a manner as to be liftable and lowerable by lifting/lowering mechanisms 3 provided respectively on-Y axis direction end surfaces (front surfaces) of a pair of block-shaped columns 101 erected vertically along the X-axis direction (left-right direction) at the +Y axis direction end part (rear end part) of the base 100. Here, the lifting/lowering mechanisms 3 are the same in configuration, and, hence, a description thereof will be made below by denoting corresponding constituent elements by the same reference characters.

The lifting/lowering mechanisms 3 are mechanisms for respectively lifting and lowering the rough grinding unit 20 and the finish grinding unit 30 along the Z-axis direction (vertical direction) independently, and each include a rectangular plate-shaped lifting/lowering plate 4 and guide rails 5 for guiding the lifting and lowering of the lifting/lowering plate 4. Here, the rough grinding unit 20 and the finish grinding unit 30 are attached respectively to the lifting/lowering plates 4. In addition, the guide rails 5 are vertically disposed on the front surfaces of the columns 101.

Between the paired guide rails 5, a rotatable ball screw 6 is erected vertically along the Z-axis direction (vertical direction), and an upper end of the ball screw 6 is connected to a servo motor 7 which is a drive source that can rotate forwardly and reversely. Besides, a lower end of the ball screw 6 is rotatably supported on the column 101 through an unillustrated bearing, and the ball screw 6 is in screw engagement with an unillustrated nut member horizontally projected from a back surface of the lifting/lowering plate 4 toward the rear side (in the +Y axis direction).

Hence, when the servo motor 7 of each of the lifting/lowering mechanisms 3 configured as above is started to rotate each of the ball screws 6 forwardly or reversely, each of the lifting/lowering plates 4 from which the unillustrated nut members in screw engagement with the ball screws 6 are projected is lifted or lowered, so that the rough grinding unit 20 and the finish grinding unit 30 attached to the lifting/lowering plates 4 are also lifted or lowered along the Z-axis direction (vertical direction) independently from each other.

As depicted in FIG. 1, the grinding water supply unit 40 is a unit for supplying grinding water containing a surfactant to a contact region (grinding region) between the grindstones 25*b* of the rough grinding unit 20 and the wafer W during grinding, and includes a grinding water supply source 41. Here, a pure water supply source 43 and a surfactant supply source 44 are connected to the grinding water supply source 41, and the surfactant supplied from the surfactant supply source 44 is mixed, at the grinding water supply source 41, with pure water supplied from the pure water supply source 43 to the grinding water supply source 41, whereby the grinding water containing the surfactant is produced at the grinding water supply source 41. Note that, in the present embodiment, the concentration of the surfactant contained in the grinding water is set on the order of 0.1%.

A piping 42 extends from the grinding water supply source 41, and two branch pipes 42*a* and 42*b* are branched from the piping 42. The branch pipes 42*a* and 42*b* are connected respectively to unillustrated supply channels formed in axial center parts of the spindle motors 22 and 32 of the rough grinding unit 20 and the finish grinding unit 30, and on-off valves V1 and V2 are provided respectively at intermediate parts of the branch pipes 42*a* and 42*b*. Note that, though not illustrated, the unillustrated supply channels formed in the axial center parts of the spindle motors 22 and 32 of the rough grinding unit 20 and the finish grinding unit 30 communicate with unillustrated supply channels formed in the spindles 23 and 33, the mounts 24 and 34, and the grinding wheels 25 and 35 of the rough grinding unit 20 and the finish grinding unit 30, and, by switching the opening and closure of the on-off valves V1 and V2, the grinding water containing the surfactant is selectively supplied to the contact region (grinding region) between the grindstones 25*b* or 35*b* of the rough grinding unit 20 or the finish grinding unit 30 and the wafer W during grinding.

Next, the grinding method for the wafer W according to the present invention that is carried out by the grinding apparatus 1 configured as above will be described below.

The grinding method for the wafer W according to the present invention is a method of grinding the reverse side of the wafer W through (1) a protective member forming step, (2) a holding step, and (3) a grinding step. These steps will be respectively described below.

Figure 3A:
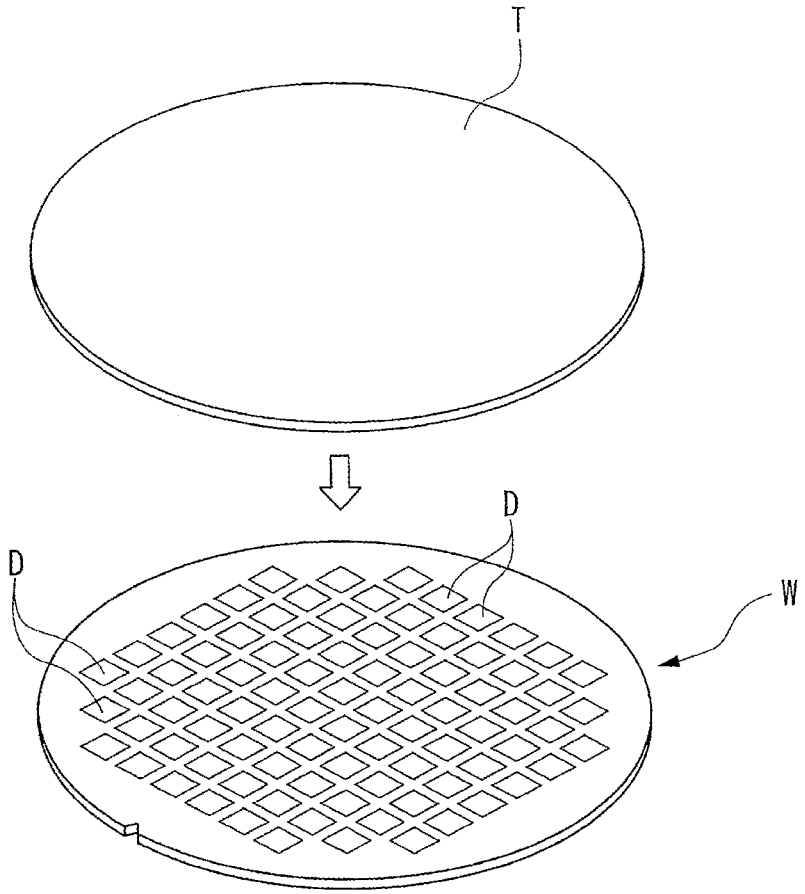
FIG. 3A is an exploded perspective view of the wafer and a protective tape.
Figure 3B:
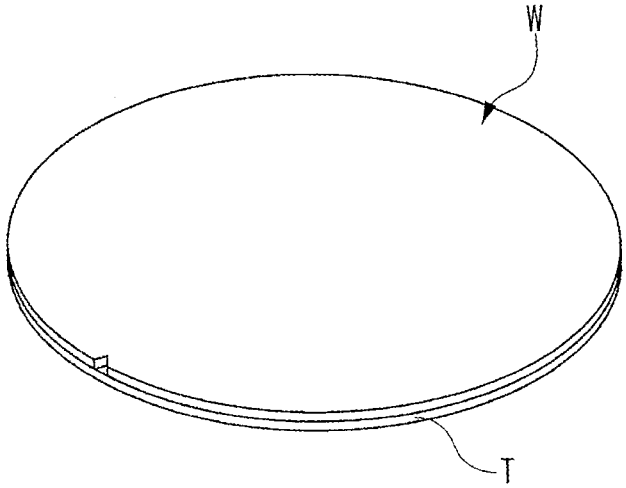
FIG. 3B is a perspective view of the wafer with the protective tape stuck thereto.

The protective member forming step is a step in which the protective tape T which is a protective member is stuck to the face side (in FIG. 3B, a lower surface) of the wafer W, as depicted in FIGS. 3A and 3B. In other words, when the thin circular protective tape T is stuck to the face side (in FIG. 3A, the upper surface) of the wafer W formed with the plurality of devices D, as depicted in FIG. 3A, the plurality of devices D formed on the face side (in FIG. 3B, the lower surface) of the wafer W are protected by the protective tape T.

The holding step is a step of holding the wafer W, with the protective tape T stuck to the face side thereof by the above-mentioned protective member forming step, on the holding surface 10*a* of the chuck table 10 with the protective tape T on the lower side, as depicted in FIG. 4, and, in this holding step, the porous member 10A of the chuck table 10 is connected to the suction source 11 depicted in FIG. 4. As a result, vacuum is applied to the porous member 10A by the suction source 11, whereby a negative pressure is generated on the porous member 10A, and the wafer W is held under suction on the holding surface 10*a* of the chuck table 10 together with the protective tape T by being drawn by the negative pressure, as depicted in FIG. 4.

Figure 5:
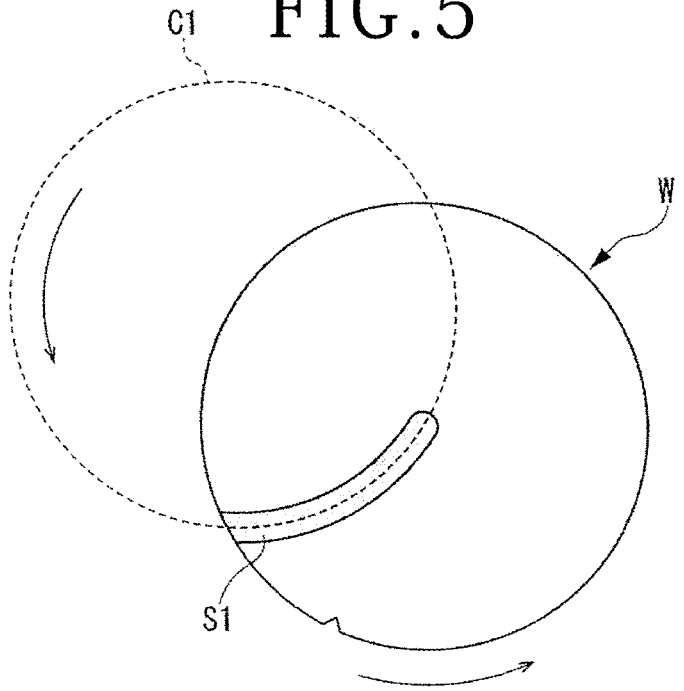
FIG. 5 is a plan view depicting a relation between the wafer and grindstones in the rough grinding step of the wafer grinding method according to the present invention.
Figure 6:
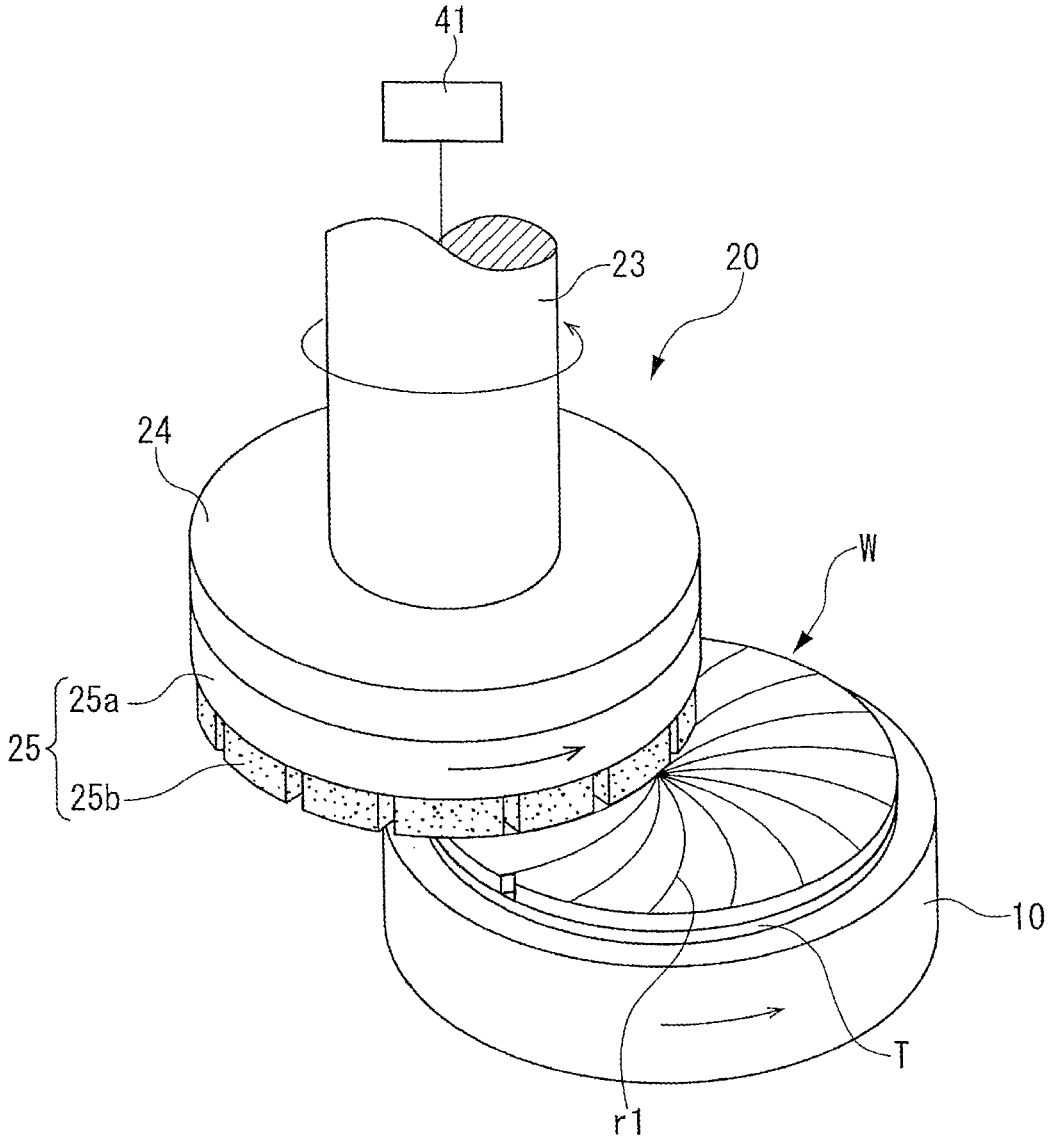
FIG. 6 is a partial perspective view depicting the rough grinding step of the wafer grinding method according to the present invention.
Figure 7:
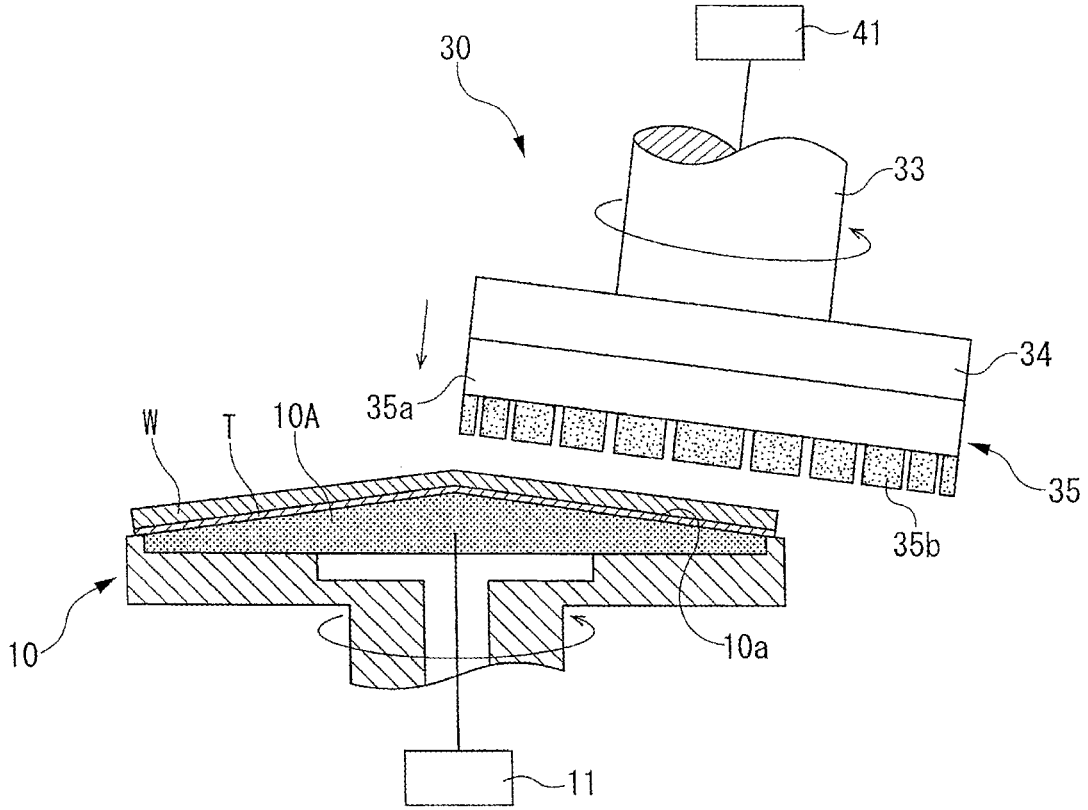
FIG. 7 is a partial side sectional view depicting the holding step and a finish grinding step of the wafer grinding method according to the present invention.
Figure 8:
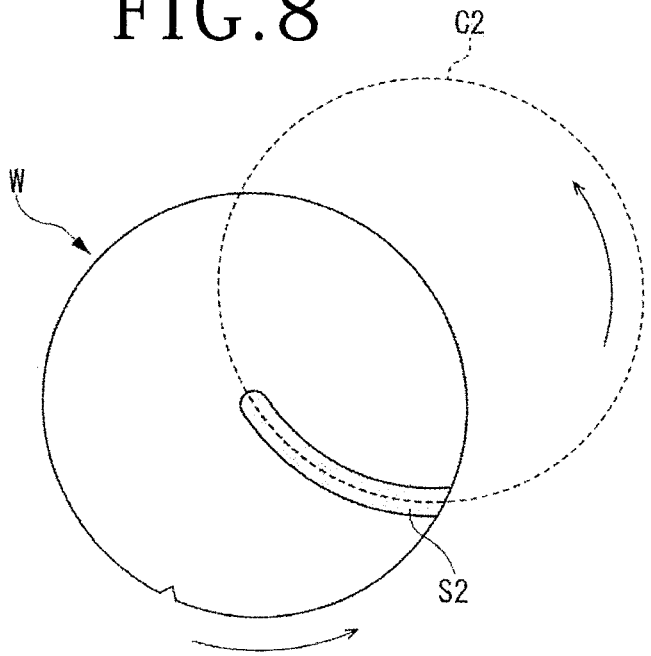
FIG. 8 is a plan view depicting a relation between the wafer and the grindstones in the finish grinding step of the wafer grinding method according to the present invention.
Figure 9:
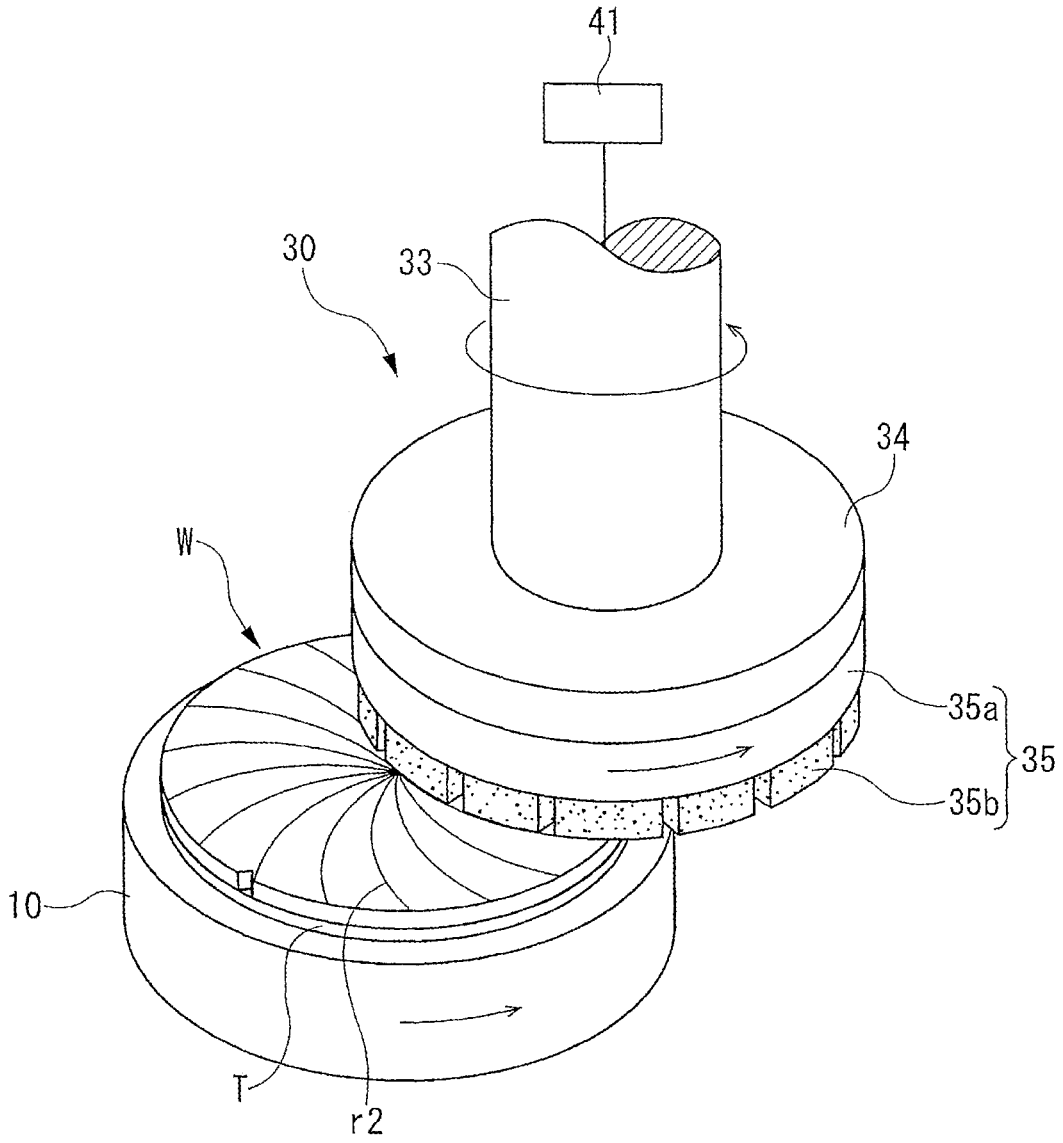
FIG. 9 is a partial perspective view depicting the finish grinding step of the wafer grinding method according to the present invention.

The grinding step includes a rough grinding step of performing rough grinding of the reverse side (in FIG. 4, the upper surface) of the wafer W held on the holding surface 10*a* of the chuck table 10, as depicted in FIGS. 4 to 6, and a finish grinding step of performing finish grinding of the reverse side (in FIG. 7, the upper surface) of the wafer W held on the holding surface 10*a* of the chuck table 10, as depicted in FIGS. 7 to 9, and the rough grinding step and the finish grinding step will be described below.

As has been described above, the rough grinding step is a step in which the reverse side of the wafer W held on the holding surface 10*a* of the chuck table 10 is subjected to rough grinding. As depicted in FIG. 4, the holding surface 10*a* of the chuck table 10 is configured as a conical surface having the center thereof as an apex and being inclined downward toward a radially outer side, and the chuck table 10 is driven to be rotated in a direction of a depicted arrow around a vertical axis passing through the center thereof. Meanwhile, the spindle 23 and the grinding wheel 25 of the rough grinding unit 20 are adjusted in inclination by an unillustrated inclination adjusting mechanism in such a manner as to become parallel to the holding surface 10*a* (radial area) of the chuck table 10, and are driven to be rotated in a direction of a depicted arrow by the spindle motor 22 depicted in FIG. 1.

In order to perform rough grinding of the reverse side (in FIG. 4, the upper surface) of the wafer W by the rough grinding unit 20, positioning is conducted such that a circumscribed circle of the grindstones 25*b* passes the center of the wafer W held on the holding surface 10*a* of the chuck table 10.

When the grindstones 25*b* are lowered in the −Z axis direction by the lifting/lowering mechanism 3 depicted in FIG. 1, from the above-mentioned state, the lower surfaces (grinding surfaces) of the grindstones 25*b* are rotated while making contact with the reverse side (upper surface) of the wafer W, so that the reverse side (upper surface) of the wafer W undergoes rough grinding. Here, the rotational trajectory of the grindstones 25*b* is denoted by C1 in FIG. 5, and the grindstones 25*b* make contact with the reverse side of the wafer W in an arcuate region S1 depicted in FIG. 5, to thereby perform rough grinding of the whole area of the reverse side (upper surface) of the wafer W. Then, when the reverse side (upper surface) of the wafer W has undergone rough grinding by the grindstones 25*b*, a plurality of arcuate grinding traces r1 extending from the center to a peripheral edge part of the wafer W are formed radially in the reverse side (upper surface) of the wafer W, as depicted in FIG. 6.

At the time of rough grinding of the wafer W, the grinding water containing the surfactant is supplied from the grinding water supply source 41 of the grinding water supply unit 40 depicted in FIG. 1 to the contact region (grinding region) S1 (see FIG. 5) between the grindstones 25*b* of the rough grinding unit 20 and the wafer W. In other words, when the on-off valve V1 is opened in a state in which the on-off valve V2 is closed, the grinding water containing the surfactant is supplied from the grinding water supply source 41 to the contact region (grinding region) S1 between the grindstones 25*b* and the wafer W by passing through the piping 42 and the branch pipe 42*a* as well as the unillustrated supply channels formed at axial centers of the spindle motor 22, the spindle 23, and the like of the rough grinding unit 20, to be served for cooling and cleaning of the contact region (grinding region) S1. Note that the concentration of the surfactant contained in the grinding water is not limited to 0.1%, and may be determined as desired in the range of 0.01% to 0.2%. Note that, in the case of the rough grinding, the swarf which is discharged is coarser and is less liable to adhere to the wafer W in proportion to the size of the abrasive grains of the grindstones 25*b*, so that the concentration of the surfactant may be 0.01%.

In addition, during the rough grinding of the wafer W by the grindstones 25*b* of the rough grinding unit 20, the thickness of the wafer W is measured by the thickness measuring device 51 depicted in FIG. 1, and the rough grinding of the wafer W is continued until the thickness of the wafer W measured by the thickness measuring device 51 reaches a target thickness. When the rough grinding is finished as the grinding amount of the wafer W has reached a predetermined amount, the turntable 2 depicted in FIG. 1 is rotated by an angle of 120° in a direction of a depicted arrow, so that the chuck table 10 is also revolved by the same angle, to be moved from the rough grinding region R2 to the finish grinding region R3. Then, the reverse side (upper surface) of the wafer W held by the chuck table 10 having moved to the finish grinding region R3 is processed by the finish grinding unit 30 in a manner similar to that of the rough grinding.

As has been described above, the finish grinding step is a step of performing finish grinding of the reverse side of the wafer W held on the holding surface 10*a* of the chuck table 10, in which the holding surface 10*a* of the chuck table 10 is driven to be rotated in a direction of a depicted arrow around a vertical axis passing through the center thereof, as depicted in FIG. 7. Meanwhile, the spindle 33 and the grinding wheel 35 of the finish grinding unit 30 are adjusted in inclination by the unillustrated inclination adjusting mechanism in such a manner as to become parallel to the holding surface 10*a* (radial area) of the chuck table 10, and are driven to rotate in a direction of a depicted arrow by the spindle motor 32 depicted in FIG. 1.

In order to perform the finish grinding of the reverse side (in FIG. 7, the upper surface) of the wafer W by the finish grinding unit 30, positioning is conducted such that a circumscribed circle of the grindstones 35*b* passes through the center of the wafer W held on the holding surface 10*a* of the chuck table 10.

When the grindstones 35*b* are lowered in the −Z axis direction by the lifting/lowering mechanism 3 depicted in FIG. 1, from the above-mentioned state, the lower surfaces (grinding surfaces) of the grindstones 35*b* are rotated while making contact with the reverse side (upper surface) of the wafer W, so that the reverse side (upper surface) of the wafer W undergoes finish grinding. Here, while the rotational trajectory of the grindstones 35*b* is denoted by C2 in FIG. 8, the grindstones 35*b* make contact with the reverse side of the wafer W in an arcuate region S2 depicted in FIG. 8, to thereby perform finish grinding of the whole area of the reverse side (upper surface) of the wafer W. Then, when the finish grinding of the reverse side (upper surface) of the wafer W by the grindstones 35*b* is conducted, a plurality of arcuate grinding traces r2 extending in a direction opposite to that of the grinding traces r1 (see FIG. 6) formed in the reverse side (upper surface) of the wafer W in the rough grinding step are formed in the reverse side (upper surface) of the wafer W. In other words, by the start of the finish grinding, the grinding traces r2 intersecting the grinding traces r1 formed by the rough grinding are formed, resulting in a state in which only the grinding traces r2 are formed in the reverse side (upper surface) of the wafer W, and the finish grinding is completed.

At the time of finish grinding of the wafer W, the grinding water containing the surfactant is supplied from the grinding water supply source 41 of the grinding water supply unit 40 depicted in FIG. 1 to the contact region (grinding region) S2 (see FIG. 8) between the grindstones 35*b* of the finish grinding unit 30 and the wafer W. In other words, when the on-off valve V2 is opened in a state in which the on-off valve V1 is closed, the grinding water containing the surfactant is supplied from the grinding water supply source 41 to the contact region (grinding region) S2 between the grindstones 35*b* and the wafer W by passing through the piping 42 and the branch pipe 42*b* as well as the unillustrated supply channels formed in axial centers of the spindle motor 32, the spindle 33, and the like of the finish grinding unit 30, to be served for cooling and cleaning of the contact region (grinding region) S2. Note that, also in the finish grinding, the concentration of the surfactant contained in the grinding water is set at 0.1%, but the concentration of the surfactant contained in the grinding water is not limited to 0.1%, and may be determined as desired in the range of 0.01% to 0.2%. Note that, in the case of the finish grinding, since the size of the abrasive grains of the grindstones 35*b* is smaller than that of the abrasive grains of the grindstones 25*b* used for the rough grinding, the swarf which is discharged is finer and is liable to adhere to the wafer W in proportion to the size of the abrasive grains of the grindstones 35*b*, so that the concentration of the surfactant may be 0.2%.

In addition, during the finish grinding of the wafer W by the grindstones 35*b* of the finish grinding unit 30, the thickness of the wafer W is measured by the thickness measuring device 52 depicted in FIG. 1, and the finish grinding is continued until the thickness of the wafer W measured by the thickness measuring device 52 reaches a target thickness. Then, when the finish grinding is finished as the grinding amount of the wafer W has reached to a predetermined amount, the turntable 2 depicted in FIG. 1 is rotated in the direction of the arrow by an angle of 120°, so that the chuck table 10 is also revolved by the same angle, to be moved from the finish grinding region R3 to the wafer conveying-in/out region R1. Then, the wafer W held by the chuck table 10 having moved to the wafer conveying-in/out region R1 is held by the second conveying unit 90 and is conveyed to the cleaning unit 50 depicted in FIG. 1.

The wafer W having been conveyed to the cleaning unit 50 is held on a spinner table 53 of the cleaning unit 50 and is rotated together with the spinner table 53, and the to-be-ground surface (upper surface) thereof is cleaned by a jet of cleaning water from a cleaning water jet nozzle 54. The wafer W having its to-be-ground surface thus cleaned is held by the conveying-in/out robot 84 and is conveyed to the cassette 82, to be accommodated into the cassette 82, whereby a series of grinding operations on the wafer W are finished.

As has been described above, in the grinding method for the wafer W according to the present invention, at the time of grinding, in the grinding steps (the rough grinding step and the finish grinding step), the reverse side of the wafer W held by the chuck table 10 with the protective tape T therebetween in the holding step, the grinding water containing the surfactant is supplied to the contact region (grinding region) S1 or S2 (see FIGS. 5 and 8) between the grindstones 25*b* or 35*b* and the wafer W, so that the abrasive grains falling off from the grindstones 25*b* or 35*b* during grinding are separated and removed from the grinding water by an action of the surfactant. Hence, invasion of the abrasive grains into the area between the lower surfaces (grinding surfaces) of the grindstones 25*b* or 35*b* and the reverse side (to-be-ground surface) of the wafer W is prevented, and formation of scratches in the reverse side of the wafer W by the abrasive grains is restrained. As a result, there is obtained an effect that the die strength of chips obtained by dividing the ground wafer W is prevented from being lowered. In addition, deposition of swarf (particles) on the reverse side (to-be-ground surface) of the wafer W after the grinding can be suppressed. As a result, cleaning of the wafer W in the state of being held by the chuck table 10 can be completed in a short period of time.

Note that, in the grinding apparatus 1 according to the above-described embodiment, a system in which the grinding water is supplied from axial centers of the rough grinding unit 20 and the finish grinding unit 30 toward the wafer W has been adopted, but it is also possible to adopt a system in which the grinding water is supplied sideways from a cleaning water jet nozzle disposed at a lateral side of the chuck table 10 toward the wafer W. Here, the cleaning water jet nozzle may include one of or both an inside nozzle that is disposed inside the grinding wheel and jets the grinding water to inside surfaces of the grindstones and an outside nozzle that is disposed outside the grinding wheel and jets the grinding water to outside surfaces of the grindstones.

In addition, the grinding apparatus 1 may be configured to include either one of the rough grinding unit 20 and the finish grinding unit 30. Further, the grinding apparatus 1 may be configured to include one grinding unit and one chuck table.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A wafer grinding method for grinding, by a grindstone, a reverse side of a wafer formed on a face side thereof with a plurality of devices, the wafer grinding method comprising:

a protective member forming step of covering a whole area of the face side of the wafer with a protective member;

a holding step of holding the wafer by a chuck table with the protective member therebetween; and a grinding step of grinding the reverse side of the wafer by the grindstone while supplying grinding water containing a surfactant to the grindstone and the wafer, wherein a concentration of the surfactant contained in the grinding water is set based on a type of grinding performed in the grinding step.

2. The wafer grinding method according to claim 1, wherein a concentration of the surfactant contained in the grinding water is in a range of 0.01% to 0.2%.

3. The wafer grinding method according to claim 1, wherein the grinding step includes a rough grinding step and a finish grinding step.

4. The wafer grinding method according to claim 3, wherein the concentration of the surfactant in the grinding water supplied in the finish grinding step is greater than the concentration of the surfactant in the grinding water supplied in the rough grinding step.

5. The wafer grinding method according to claim 4, wherein the concentration of the surfactant in the grinding water supplied in the rough grinding step is 0.01%, and the concentration of the surfactant in the grinding water supplied in the finish grinding step is 0.2%.

6. The wafer grinding method according to claim 3, wherein the concentration of the surfactant in the finish grinding step is set to suppress adhesion of swarf generated during the finish grinding step.

7. The wafer grinding method according to claim 1, wherein the grinding water is supplied through a supply channel formed along an axial center of a grinding unit.

8. The wafer grinding method according to claim 1, wherein the surfactant is configured to disperse abrasive grains separated from the grindstone in the grinding water.

9. The wafer grinding method according to claim 1, wherein the surfactant is configured to reduce adhesion of swarf to the reverse side of the wafer during grinding.

10. The wafer grinding method according to claim 1, wherein the grinding water containing the surfactant is continuously supplied to a contact region between the grindstone and the wafer during the grinding step.

11. The wafer grinding method according to claim 1, wherein a holding surface of the chuck table is a conical surface having a center as an apex and being inclined downward toward a radially outer side.

12. The wafer grinding method according to claim 3, wherein the concentration of the surfactant is set based on a size of swarf generated in the rough grinding step and the finish grinding step.

13. The wafer grinding method according to claim 3, wherein the grinding water is supplied through a first supply line corresponding to the rough grinding step and a second supply line corresponding to the finish grinding step, and valves are provided to selectively control supply of the grinding water to the first supply line and the second supply line, wherein only one of the supply lines supplies the grinding water at a time.

* * * * *